US005664277A

United States Patent [19]

Matlock

[11] Patent Number: 5,664,277

[45] Date of Patent: Sep. 9, 1997

[54] GOLF GRIP WASHING DEVICE

[76] Inventor: Roy L. Matlock, 4928 Franklin Rd., Nashville, Tenn. 37220

[21] Appl. No.: 657,664

[22] Filed: May 30, 1996

[51] Int. Cl.[6] ..... A46B 11/00

[52] U.S. Cl. ..... 15/160; 15/104.92; 15/105

[58] Field of Search ..... 15/21.2, 105, 106, 15/104.92, 160, 161; 401/9, 10

[56] References Cited

U.S. PATENT DOCUMENTS

| | | | |
|---|---|---|---|
| 2,617,132 | 11/1952 | Goller | 15/21.2 |
| 3,224,029 | 12/1965 | Domingos | 15/104.92 |
| 3,478,676 | 11/1969 | Warren et al. | 15/21.2 |
| 4,554,696 | 11/1985 | Nye, Jr. . | |
| 4,676,839 | 6/1987 | Osborn . | |
| 4,750,230 | 6/1988 | Osborn . | |
| 4,897,892 | 2/1990 | Bubien . | |
| 4,946,510 | 8/1990 | Kinnebrew, II et al. . | |
| 4,953,999 | 9/1990 | Rivers . | |
| 5,094,557 | 3/1992 | Nelson . | |
| 5,269,615 | 12/1993 | Lewis, Jr. . | |

*Primary Examiner*—David Scherbel
*Assistant Examiner*—Terrence Till
*Attorney, Agent, or Firm*—Waddey & Patterson; I. C. Waddey, Jr.

[57] ABSTRACT

A golf grip cleaning device mounted on a support which is in turn mounted on a base. The base can be stationed at the tee box of the golf course or can be mounted on a golf car itself. For convenience and economics, the entire assembly can be made out of readily available PVC plumbing parts. The washer section includes a tube having a plug at the bottom end and a cap at the top end. The cap has an open mouth so that the golf club can be inserted into the tube. The tube is aligned vertically and has a series of brush rings stacked in the tube and spaced from each other by spacers inserted between each brush ring. The brush rings include bristles projecting radially inwardly toward the axial center of the tube with the brush tips terminating generally in a circular pattern. The diameter of the circular pattern of the brush tips is generally consistent throughout the length of the tube and at a diameter equal to or slightly larger than the maximum outside diameter of the grip of a standard golf club. The mouth at the top of the washer tube is several inches in diameter so that the club can be cleaned by agitating it in an up and down motion as well as sitting the butt of the club on the plug at the bottom of the tube and moving the club in a wobble motion so as to cause the grip to come into contact with the tips of the bristles in a substantially perpendicular relationship to the perimeter of the grip thereby facilitating the tips of the bristles in their cleaning action against the surface of the grip. The tube can be filled with a cleaning fluid to assist in the cleaning process.

11 Claims, 6 Drawing Sheets

GOLF GRIP WASHING DEVICE

BACKGROUND OF THE INVENTION

The present invention relates generally to a golf club cleaning device and more particularly to a golf club grip washer.

It will be appreciated by those skilled in the art that the game of golf is one of the most difficult and demanding sports engaged in by participants on a worldwide basis. Those familiar with the game realize that the slightest variation in the participant's golf swing is magnified many times over in its consequence on the golfers performance and success. Thus, it is important in the play of the game, and critical in competitive play, that participants eliminate every uncontrolled variant.

The grips on golf clubs, originally formed by wrapping leather around the butt end of the club, and in more modem times by forming a sleeve fitting over the butt end of the club where the sleeve is made of rubber or rubber-like synthetic material, can have a significant impact on the ability of a golfer to execute a desired shot. The grips transfer the "feel" of the club to the golfer's hands and enable the golfer to better execute the desired shot. Conversely, when the golf club grips are soiled and dirty, or become hardened through years of exposure to the elements, the golfer loses the "feel" of the club. Also, when the golf club grips are dirty, they become slick because the relief formed in the outer surface of the grip has been filled and is smooth to the touch. Smooth surface on a grip will cause the club to slip in the golfer's hands and prevent the golfer from being able to execute the desired shot. Thus, it is important to have clean and properly conditioned equipment for a golfer to achieve maximum performance.

Golfer's are prone to clean the heads of their golf clubs after each shot and in humid or damp climates, golfers tend to wipe their club grips after every shot. The grooves in the golf club heads can also be cleaned by brushes that are attached to the golfer's bag or that may be available adjacent various tee boxes or carried on golf carts. Brushes for washing golf club grips have also been in existence for many years, but such golf club grip cleaners have a variety of deficiencies.

As is well known to golfing enthusiasts, the grips of golf clubs are tapered slightly from the butt end of the club toward the hosel of the club. Designing a device for conveniently and easily cleaning the tapered grips is difficult and the prior art devices have achieved limited success in that effort. Most prior art devices have been designed to have a sleeve into which the golf club grip is inserted and the sleeve is fitted with brush bristles generally projecting radially inwardly toward a center axis within the sleeve. In most situations, the club is agitated within the sleeve or the sleeve is rotated about the grip of the club, and the tips of the bristles have an open center core of a size that tends to flex against the outer surface of the grip. For example, in U.S. Pat. No. 5,269,615, there is shown, in FIG. 2, a set of bristles for a prior art device of the type being discussed where the opening in the center of the brush is tapered in some effort to accommodate the shape of the grip. However, as can be seen in FIG. 4 of the '615 patent, all the bristles are of a length so that the bristles tend to flatten out against the outer surface of the grip. Thus, the bristles tend to lay on their side when the golf club is inserted into the device and is agitated for cleaning. When the bristles are bent, there is a smooth flat surface of the bristle that works on the outer surface of the grip, rather than the tip of the bristle to get into the crevices of the grip in order to adequately clean them.

In addition to the problem of bristles flattening out against the grip, most prior art grip cleaning devices are expensive and difficult to manufacture and assemble, necessitating a higher selling price and therefore preventing such devices from being readily marketable to the public and private sectors.

What is needed, then, is a golf grip cleaning device that is simple and inexpensive to manufacture, is efficient in operation, is long-lasting, and can be readily serviced and repaired. Such devices are not presently available on the market place or illustrated in the prior art.

It is therefore an object of the present invention to provide a golf grip cleaning device that is simple and inexpensive to manufacture, is efficient in its operation, is easy and inexpensive to repair and maintain, and can be modified and made readily available to both the public and private golf club sectors.

SUMMARY OF THE INVENTION

My invention is a golf grip cleaning device mounted on a support which is in turn mounted on a base. The base can be stationed at the tee box of the golf course or can be mounted on a golf car itself. For convenience and economics, the entire assembly can be made out of readily available PVC (polyvinyl-chloride) plumbing parts. The washer section includes a tube having a plug at the bottom end and a cap at the top end. The cap has an open mouth so that the golf club can be inserted into the tube. The tube is aligned vertically and has a series of brush rings stacked in the tube and spaced from each other by spacers inserted between each brush ring. The brush rings include bristles projecting radially inwardly toward the axial center of the tube with the brush tips terminating generally in a circular pattern. The diameter of the circular pattern of the brush tips is generally consistent throughout the length of the tube and at a diameter equal to or slightly larger than the maximum outside diameter of the grip of a standard golf club. The mouth at the top of the washer tube is several inches in diameter so that the club can be cleaned by agitating it in an up and down motion as well as sitting the butt of the club on the plug at the bottom of the tube and moving the club in a wobble motion so as to cause the grip to come into contact with the tips of the bristles in a substantially perpendicular relationship to the perimeter of the grip thereby facilitating the tips of the bristles in their cleaning action against the surface of the grip. The tube can be filled with a cleaning fluid to assist in the cleaning process.

DESCRIPTION OF THE PREFERRED EMBODIMENT

My invention will be best understood when consideration is given to the preferred embodiment of the invention as illustrated in FIGS. 1–10 of the drawings.

Figure 1:
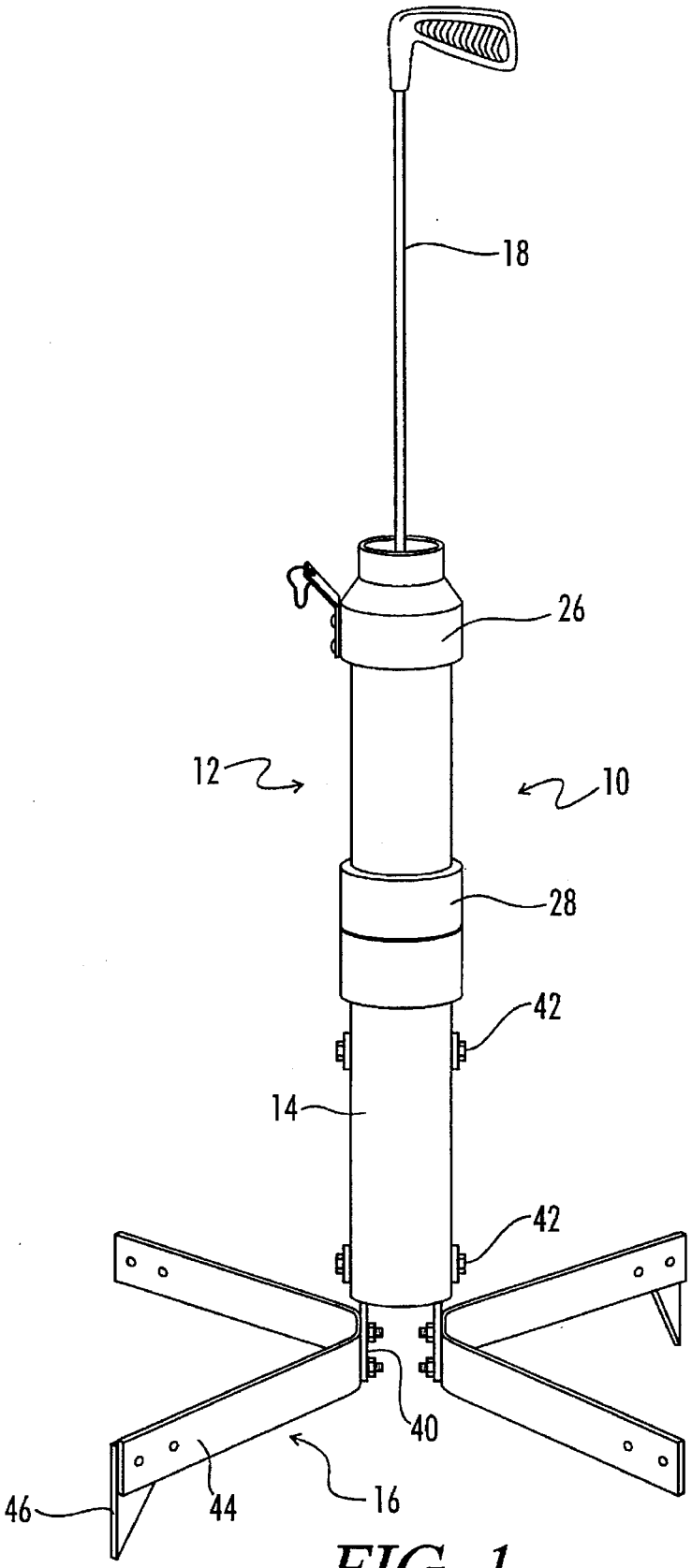
FIG. 1 is a perspective view of the golf club grip washer of my invention.
Figure 2:
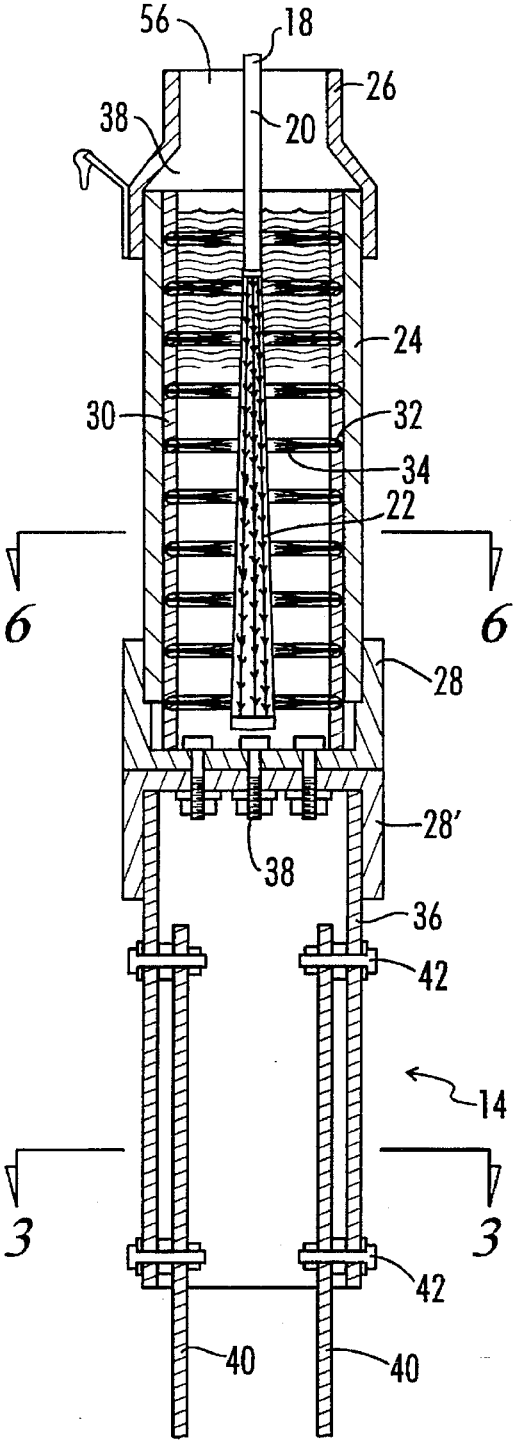
FIG. 2 is a plane view in cross section of the washer and support potions of my invention.
Figure 3:
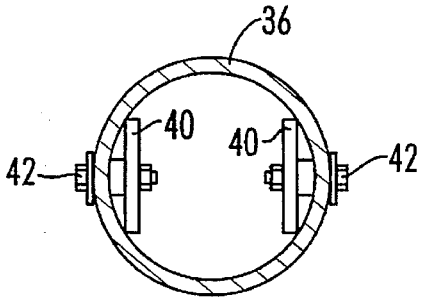
FIG. 3 is a cross section taken along the line 3—3 of FIG. 2.

Looking at FIGS. 1 and 2, there is shown generally my golf grip washer 10 including a washer section 12, a support section 14 and a base 16. FIGS. 1 and 2 also illustrate a golf club 18 extending into the washer section 12 of the golf grip washer 10.

The golf club 18 includes a shaft 20 and a grip 22 fitted over the butt end of the shaft. As can be seen from FIG. 2, the grip 22 is tapered from its largest diameter at the extreme butt end of the shaft 20 to its narrowest diameter at the point of the grip 22 closest to the hosel of the golf club.

The washer section 12 of my golf grip washer 10 is preferably constructed from readily available PVC plumbing supplies including a tube section 24 having a lower end and an upper end with the upper end covered by a cap 26. The cap 26 can be attached to the upper end of the tube 24 by either screws passing between the base of the cap into the upper end of the tube 24 or by gluing the cap onto the tube. However, the attachment of the cap to the tube by screws is preferred because it allows the cap to be easily removed for maintenance of the brushes inside the tube and/or other repair of the golf grip washer 10.

Figure 7:
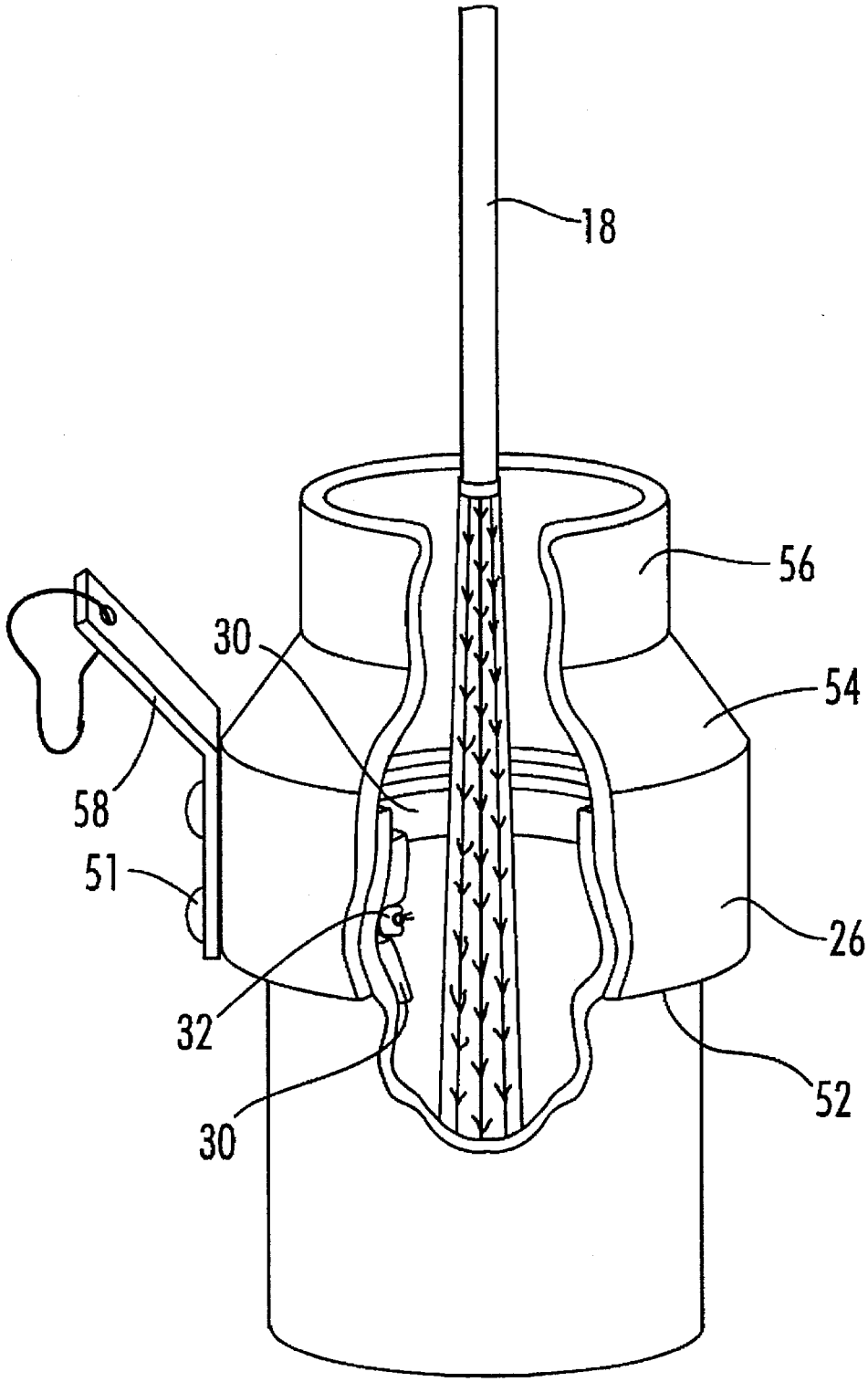
FIG. 7 is a perspective view with cut-away of the upper portion of the present invention.

In the preferred embodiment, the cap 26 is a PVC pipe reduction fitting which provides a step down from the diameter of the tube 24 to the reduced opening at the mouth 56 of the cap 26. In fact, FIG. 7 illustrates in more detail the cap 26 and shows screws 51 which can be used to attach the cap to the tube. As previously mentioned, as an alternative, the attachment of the cap to the tube may be via a friction/glue fit in the area 52 where the larger portion of the cap 26 fits over the upper part of the tube 24. The cap 26 includes a cone section 54 which is the reduction portion of the cap and a mouth area 56 which has a diameter substantially larger than the golf club so that the proper washing motion can be given to the golf club when it is in the golf club grip washer of my invention.

Figure 4:
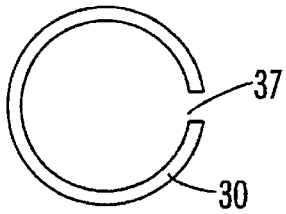
FIG. 4 is a plane view of the spacer.
Figure 5:
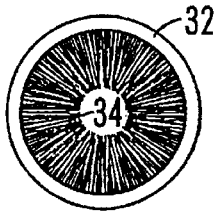
FIG. 5 is a plane view of the brush ring.
Figure 6:
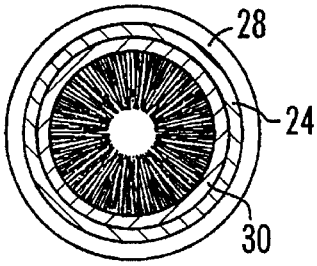
FIG. 6 is a cross sectional view taken along the line 6—6 of FIG. 2.

Returning now to FIGS. 1 and 2 and also FIGS. 4–6, the washer section 12 of my golf grip washer 10 will be described in greater detail. At the lower end of the tube 24, there is a seal 28 which joins with the tube 26 to form a liquid-tight chamber within the tube 24. The seal 28 can either be a plug which fits within the tube 24 or a cap that fits about the tube 24 as is shown in FIG. 2.

Within the chamber of the tube 24, the cleaning mechanism of my golf grip washer device 10 is assembled. The cleaning mechanism includes a series of brush rings 32 separated by alternately placed spacers 30. Each brush ring 32 has bristles projecting radially inwardly toward the axis of the tube 24 with the bristles terminating in such a manner that the tips of the bristles form a circular opening having a diameter d. Because the brush rings 32 are stacked, the tips of the bristles 34 create a channel that is constant from the top to the bottom of the tube 24 and the diameter of the channel is substantially equal to the maximum diameter of the grip 22 so that at the upper part of the tube 24, the bristles do not touch the grip and when the grip is axially aligned with the tube.

The spacers 30 can be made from a length of PVC pipe of the same diameter as the diameter of the tube 24 by cutting a 37 in the perimeter of the pipe axially along its length. The pipe is then sliced along a plane perpendicular to its axis to create spacers 30 to be inserted between each brush ring 32. The 37 in each spacer allows the spacer to be compressed and fitted within the inside diameter of the tube 24, but when the compressive force is released, the spacer 30 will expand and provide a frictional fit inside the chamber of tube 24. This holds the brush rings 32 in place against movement when the golf club 18 is within the washer section and being agitated in order to wash the grip 22.

The support section 14 of my golf grip washer 10 includes a pipe tube 36 that has a seal 28' over the upper end thereof so that seals 28 and 28' may be attached via fasteners such as bolt/nut combinations 38 to attach the washer section 12 to the support section 14. The bolt/nut fasteners 38 may require washers to seal the inner chamber of the tube 24 and keep liquid from draining out of it. The pipe 36 is open at the bottom and is connected to braces 40 by fasteners such as bolts 42. The lower section of the braces 40 are attached to the legs 44 which are U-shaped bars giving the golf grip washer 10 a solid, stable base 16. The ends of the legs 44 may be provided with spikes 46 that can be pressed into the turf in order to further stabilize the golf grip washer 10.

Looking back at FIG. 2, the chamber within the tube 24 is filled with liquid washer fluid 38 so that when a golf club 18 is placed, butt end first, into the washer, the grip 22 will be submerged into the washer fluid. The butt end of the club 18 can sit on the bottom of the chamber within the tube 24 and the club can then be rotated by the golfer in a wobble motion. This motion of the club will cause the grip to both rotate and oscillate, thereby causing the tips of the bristles 34 to contact perpendicularly the surface of the grip 22 and penetrate into the grooves cut into the surface of the grip 22 to clean debris from those grooves. Because the diameter d is larger than the diameter of the grip of the club except at the extreme most butt end of the club, the agitation and rotation of the club 18 enables the tips of the bristles 34 to effectively clean the grip without the bristles being bent flat against the side of the grip and thereby losing their effective ability to penetrate the grooves in the grip itself. The club can also be spun and moved in a nutation motion because of the larger open mouth of the cap, further enhancing the ability of the bristles to clean and revitalize the grips 22.

Figure 8:
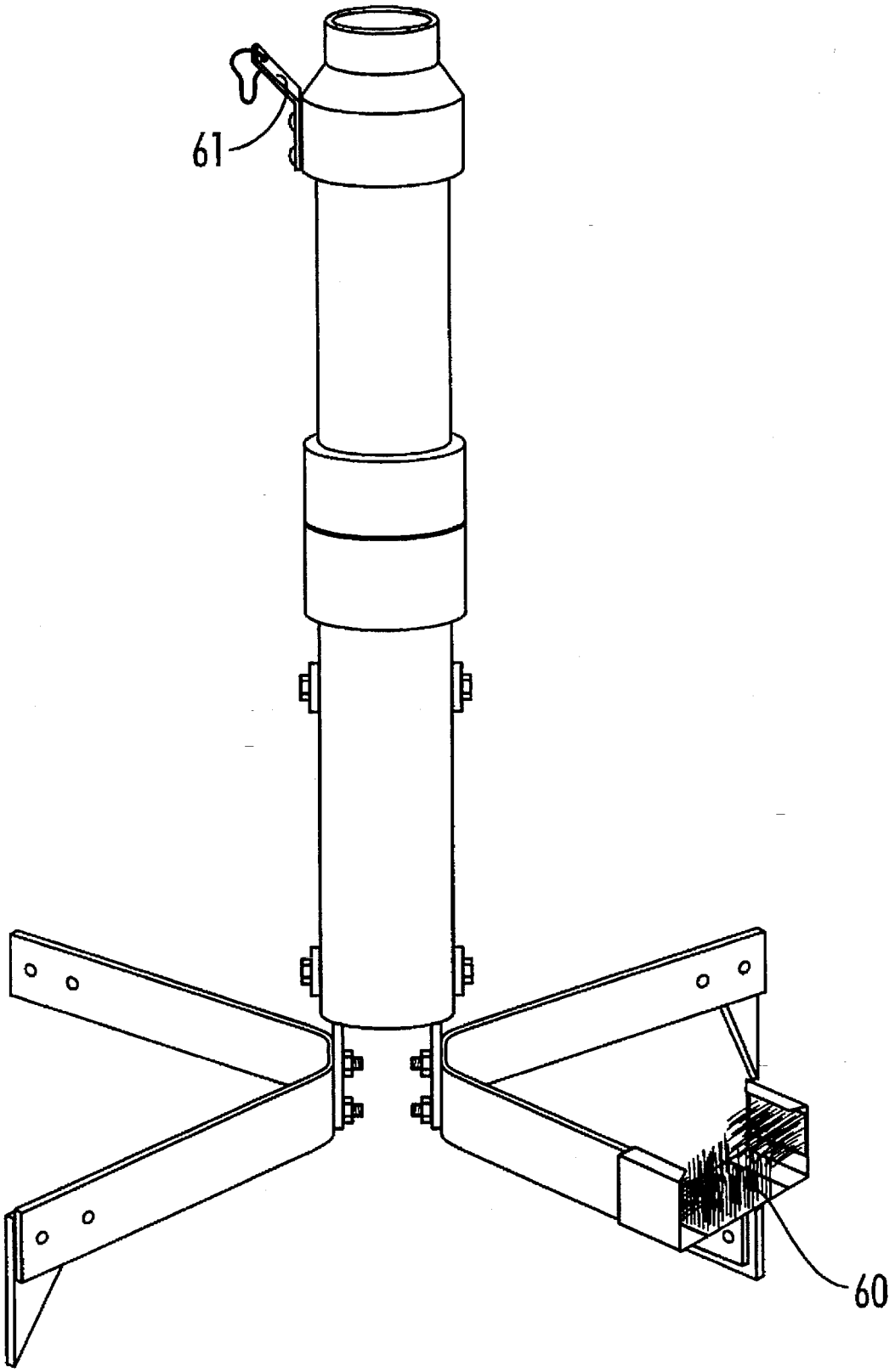
FIG. 8 is another perspective view showing the shoe brush attachment to the present invention.

As can be seen from FIG. 8, my golf grip washer can also include a spike cleaner brush attached to one of the legs 44 of the base 16 and a towel holder 61 at the top of the cleaner. The towel holder 61 can be connected to the cap 26 by the same screws that attach the cap to the upper portion of the tube 24.

Figure 9:
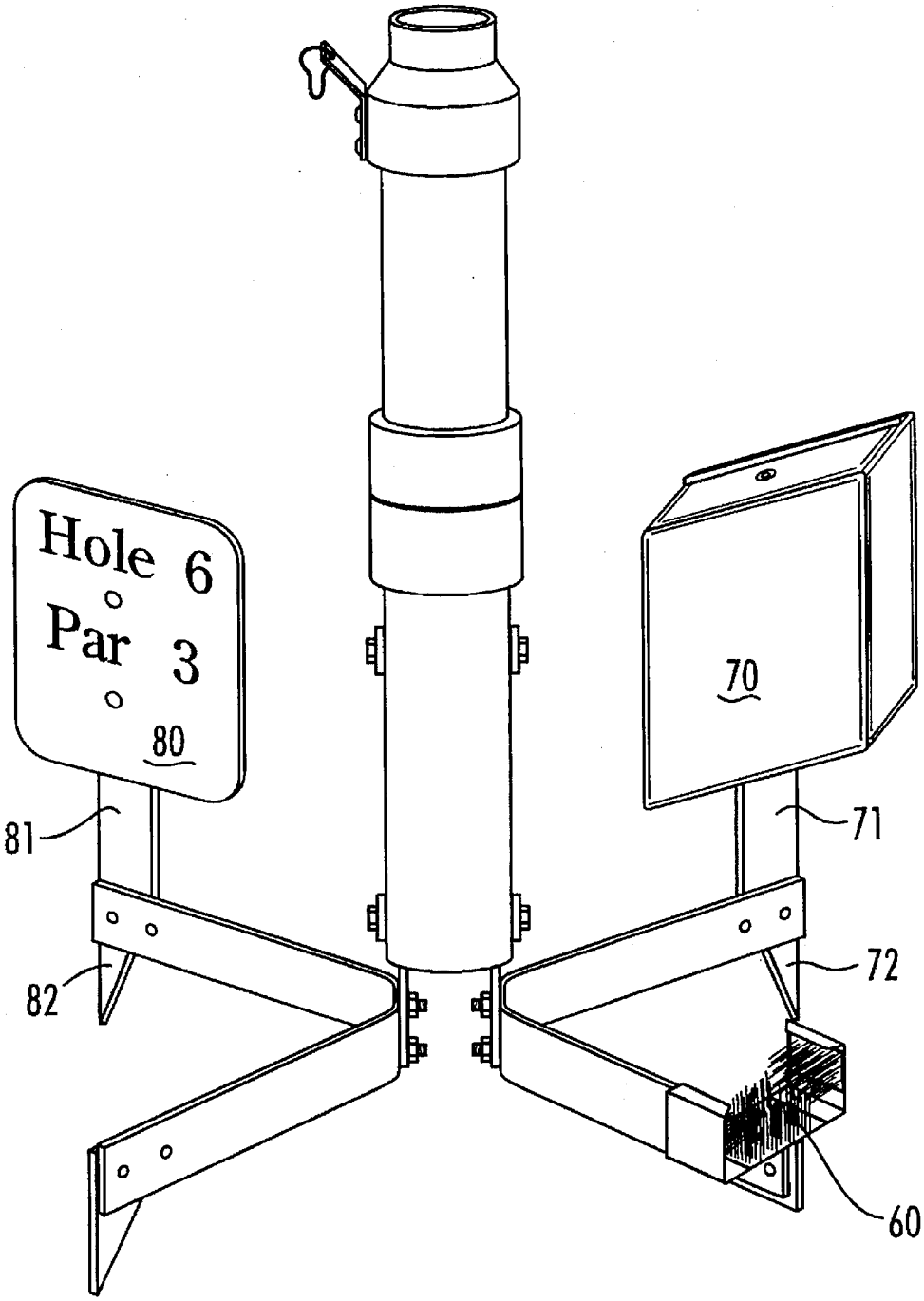
FIG. 9 is another perspective view showing a trash receptacle, yard marker, and shoe brush attached to the present invention.

FIG. 9 illustrates further enhancements of my golf grip washer 10 including a trash receptacle 70 and a yardage marker plaque 80. When the yardage marker and/or trash receptacle accessories are added to the base of the washer, the lower portion of the arms 71/81 of these accessories are spiked at 72/82 so that those spikes can be forced into the turf to add further stability to the device.

Figure 10:
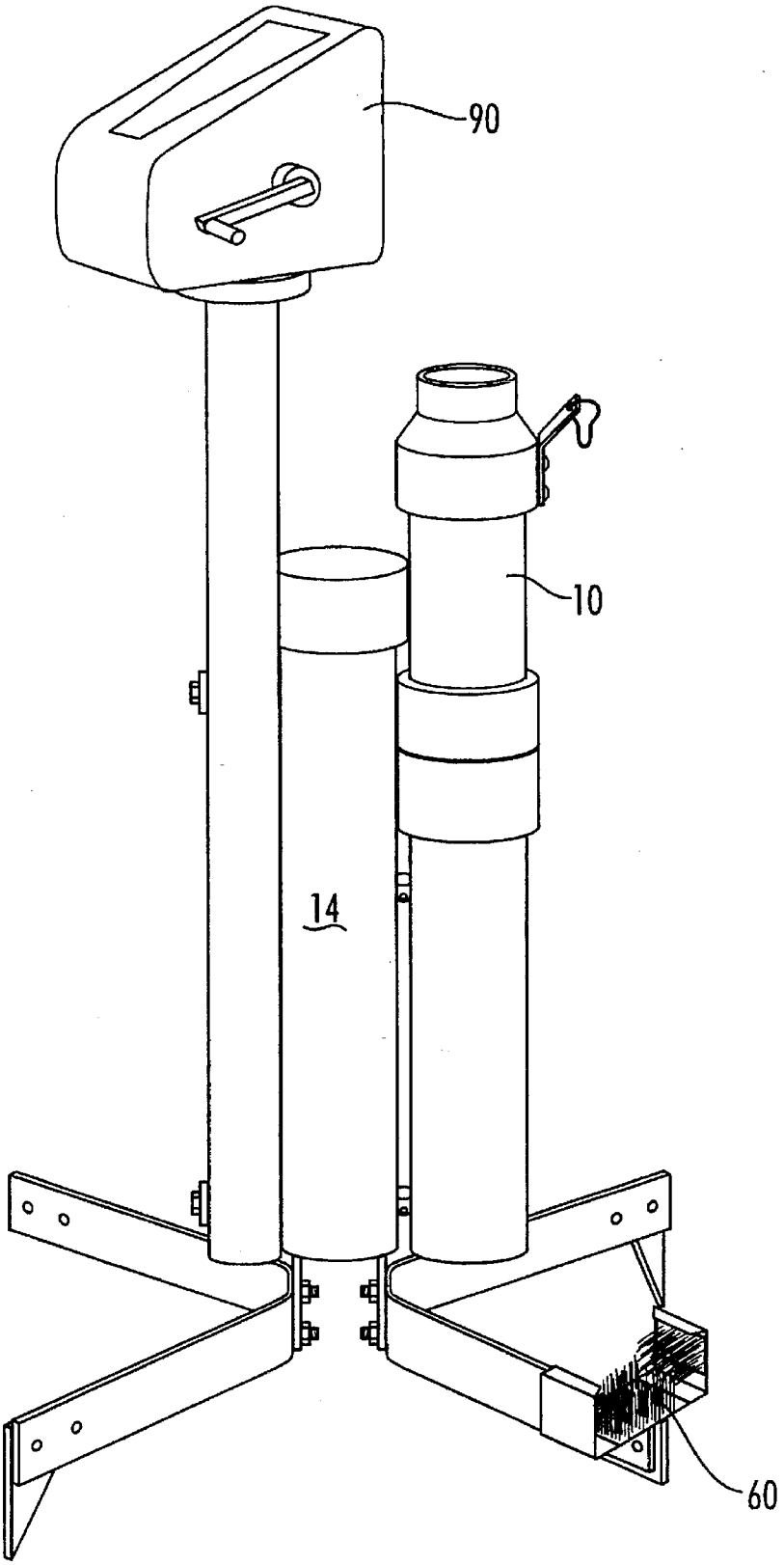
FIG. 10 is another perspective view showing the present invention with a shoe brush grip washer and ball washer attached.

Finally, FIG. 10 illustrates yet another embodiment of my invention which includes a spike brush 60, the washer 10 and a ball washer 90. The ball washer 90 can be attached to the support section 14 and the golf grip washer 10 can also be attached to the support section 14 with the attachment of the ball washer and grip washer on opposing sides of the support 14. My golf grip washer 10 and the accessories that I provide with it enable a golf course to place at the tee box of each hole, one unit that can accomplish many purposes; the golfer can wash his golf balls, clean the spikes of his shoes and clean the grips of his clubs through the use of my device and its accessories. When the golfer cleans the grips of his clubs using my device, he places the butt end of the club into the chamber of the tube 24 and moves the club in a wobble motion to get the most effective cleaning of the grip that is possible by ensuring that the tips of the bristles brush against the entire length of the grip rather than flattening out against the side of the grip to lose their effectiveness of a cleaning mechanism.

As compared to prior art devices, my golf grip washer is simple and inexpensive to manufacture, it is easy to use, it is effective in accomplishing its purpose, it can be made from parts that are readily available without having to build special molds or incur other expensive manufacturing costs. It does not have any moving parts such as pumps, motors, belts, gear trains, and the like. It does not require any power source such as electrical outlets. It can easily be disassembled for repair and maintenance, and it can be shipped in components in a compact manner that will reduce cost of handling and delivery. These advantages are missing from the prior art devices that address the problem of the need to maintain golfing equipment in order to maximize the skills of the golfer.

Although there have been described particular embodiments of the present invention of a new and useful golf grip washing device, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A golf grip washer including an elongated tube having an inner chamber with a central axis extending therethrough and a closed bottom and open top, a series of brush rings stacked axially within the chamber of said tube and spaced from each other by spacer means, said brush rings including flexible bristles projecting radially inwardly toward said central axis with the bristles terminating in tips with said tips forming a hole extending axially of the tube, said hole being of substantially constant diameter; the diameter of said hole being substantially equal to a maximum diameter of the grip of a golf club to be washed by the device, the top of said tube being partially closed by cap means, said cap means holding said brush rings and spacers within said tube and having a mouth of a diameter at least substantially twice the diameter of said hole.

2. The device according to claim 1 further including a support, said support including a base having legs to provide stability to the device.

3. The device according to claim 2 wherein said legs include spikes that can be pressed into the turf to stabilize the device.

4. The device according to claim 1 further including a second tube connected to said elongated tube and braces connected to said second tube, and a base to which said braces are connected.

5. The device according to claim 1 wherein said spacers are C-shaped rings having a gap which allows said spacers to be compressed to fit within said tube and which will expand when not compressed to wedge against said tube to hold the spacers in place.

6. The device according to claim 1 wherein said tube and said cap are constructed from PVC pipe and PVC pipe fittings.

7. The device according to claim 1 further including a towel hanger attached to said cap by screws and said screws further attaching said cap to said tube.

8. The device according to claim 1 further including a brush attached to said base for cleaning the spikes of a golfer's shoe.

9. The device according to claim 1 further including a trash receptacle mounted on said base.

10. The device according to claim 1 further including a yardage marker sign attached to said base.

11. The device according to claim 1 further including a ball washer attached to said base.

* * * * *